US007798131B2

(12) United States Patent
Hornby

(10) Patent No.: US 7,798,131 B2
(45) Date of Patent: Sep. 21, 2010

(54) AUTOMOTIVE MODULAR INDUCTIVE HEATED INJECTOR AND SYSTEM

(75) Inventor: Michael J. Hornby, Williamsburg, VA (US)

(73) Assignee: Continental Automotive Systems US, Inc., Auburn Hills ( * ) Notice: Subject to any disclaimer, the term of this patent is extended or adjusted under 35 U.S.C. 154(b) by 330 days.

(21) Appl. No.: 12/073,846

(22) Filed: Mar. 11, 2008

(65) Prior Publication Data

US 2008/0223346 A1 Sep. 18, 2008

Related U.S. Application Data

(60) Provisional application No. 60/907,033, filed on Mar. 16, 2007.

(51) Int. Cl.
*F02M 53/06* (2006.01)
*F02M 39/00* (2006.01)

(52) U.S. Cl. ..... 123/491; 123/549; 123/557

(58) Field of Classification Search ..... 123/491, 123/549, 557, 558, 531, 533, 453, 456, 445, 123/179.15; 251/129.01
See application file for complete search history.

(56) References Cited

U.S. PATENT DOCUMENTS 4,886,032 A * 12/1989 Asmus ..... 123/557
5,159,915 A 11/1992 Kimitaka et al.
5,172,675 A 12/1992 Kurosu et al.
5,201,341 A 4/1993 Kimitaka et al.
5,531,202 A * 7/1996 Lorraine ..... 123/456
5,758,826 A 6/1998 Nines
5,915,626 A 6/1999 Awarzamani et al.
6,176,226 B1 1/2001 Nines et al.
6,334,418 B1 1/2002 Hubbard
6,685,112 B1 2/2004 Hornby et al.
2007/0235557 A1 10/2007 Hornby et al.

FOREIGN PATENT DOCUMENTS

DE 2843534 A1 4/1979
DE 10 2005 041483 A1 3/2007
GB 2307513 A 5/1997
JP 2002-180919 A 6/2002
WO WO 2007/030906 A 2/2007
WO WO 2007/111950 A 10/2007

* cited by examiner

*Primary Examiner*—Hieu T Vo

(57) ABSTRACT

A fuel injection system (60) is provided for an internal combustion engine (62). The engine has a plurality of cylinders (70). The system includes a plurality of fuel injectors (10') constructed and arranged to receive fuel. One fuel injector is associated with a cylinder for injecting fuel into the associated cylinder. Each fuel injector has a valve body (14), a fuel volume V, and a coil (50) to inductively heat the valve body and thus heat fuel in the fuel volume to vaporize the fuel prior to injection into the associated cylinder. A cold start fuel injector (10, 10') is disposed in an air supply passage (72) that supplies air to the cylinders. The cold start fuel injector has a valve body (14), a fuel volume (V) and a coil (50) to inductively heat the valve body to vaporize the fuel in the fuel volume prior to injection into the supply passage.

20 Claims, 3 Drawing Sheets

AUTOMOTIVE MODULAR INDUCTIVE HEATED INJECTOR AND SYSTEM

This application is based on U.S. Provisional Application No. 60/907,033 filed on Mar. 16, 2007, claims the benefit thereof for priority purposes, and is hereby incorporated by reference into this specification.

FIELD OF THE INVENTION

The invention relates to fuel injectors for vehicles and, more particularly, to a modular heated fuel injector that adds thermal energy into the fuel prior to injection.

BACKGROUND OF THE INVENTION

With the introduction of ethanol as a fuel as well as a flex fuel additive for today's automotive engine systems, cold start performance and engine cold emissions have become an issue. There is a need to create new injection systems that can add thermal energy into the fuel prior to injection.

There are three conventional ways to add energy to the fuel: resistive heating, inductive heating and PTC (positive temperature coefficient) thermistors. The disadvantage of both resistive and PTC heating is that electrical connections need to be made to the heater in the fuel stream within the injector. The disadvantage of conventional Inductive heaters is that the volume and location (e.g., remote from the cylinders) of the heated fuel is not sufficient to create the volume of vaporized fuel to obtain a sufficient start at low temperatures.

Thus, there is a need to provide an improved fuel injector that adds thermal energy to fuel prior to injection so that a sufficient volume of vaporized fuel can be supplied to the engine.

SUMMARY OF THE INVENTION

An object of the present invention is to fulfill the need referred to above. In accordance with the principles of the present invention, this objective is obtained by providing a fuel injection system for an internal combustion engine. The engine has a plurality of cylinders. The system includes a fuel pump and a plurality of fuel injectors constructed and arranged to receive fuel from the fuel pump. One fuel injector is associated with a cylinder for injecting fuel into the associated cylinder. Each fuel injector has a valve body, a fuel volume, and a coil constructed and arranged to inductively heat the valve body and thus heat fuel in the fuel volume to vaporize the fuel prior to injection into the associated cylinder.

In accordance with another aspect of the invention, a fuel injection system is provided for an internal combustion engine. The engine has a plurality of cylinders. The system includes a plurality of fuel injectors constructed and arranged to receive fuel. One fuel injector is associated with a cylinder for injecting fuel into the associated cylinder. Each fuel injector has a valve body, a fuel volume, and a coil constructed and arranged to inductively heat the valve body and thus heat fuel in the fuel volume to vaporize the fuel prior to injection into the associated cylinder. A cold start fuel injector is disposed in an air supply passage that supplies air to the cylinders. The cold start fuel injector has a valve body, a fuel volume, and a coil constructed and arranged to inductively heat the valve body to vaporize the fuel prior to injection into the supply passage.

In accordance with another aspect of the invention, a method is provided for adding energy to fuel in a fuel injection system for a vehicle having a plurality of cylinders. The method provides a fuel injector associated with a cylinder for injecting fuel into the associated cylinder. Each fuel injector has a valve body, a fuel volume and a coil. Each fuel injector is supplied with fuel. The coil is activated to generate a magnetic field to inductively heat the valve body to vaporize the fuel in the fuel volume. The vaporized fuel is injected into the associated cylinder.

Other objects, features and characteristics of the present invention, as well as the methods of operation and the functions of the related elements of the structure, the combination of parts and economics of manufacture will become more apparent upon consideration of the following detailed description and appended claims with reference to the accompanying drawings, all of which form a part of this specification.

BRIEF DESCRIPTION OF THE DRAWINGS

The invention will be better understood from the following detailed description of the preferred embodiments thereof, taken in conjunction with the accompanying drawings, wherein like reference numerals refer to like parts, in which.

DETAILED DESCRIPTION OF THE EXEMPLARY EMBODIMENT

Figure 1:
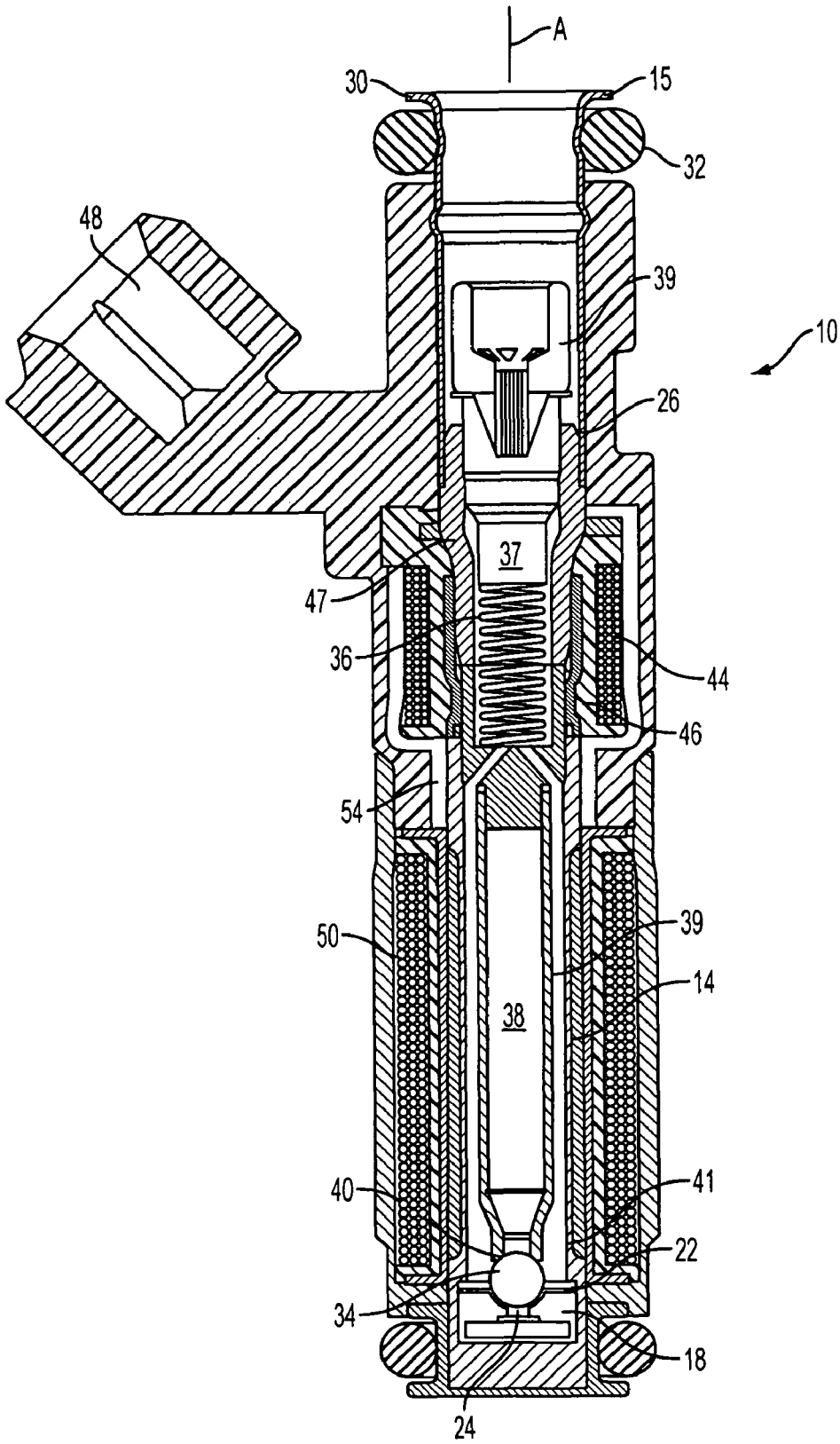
FIG. 1 is a sectional view of a fuel injector having a heating coil in accordance with an embodiment of the present invention.
Figure 3:
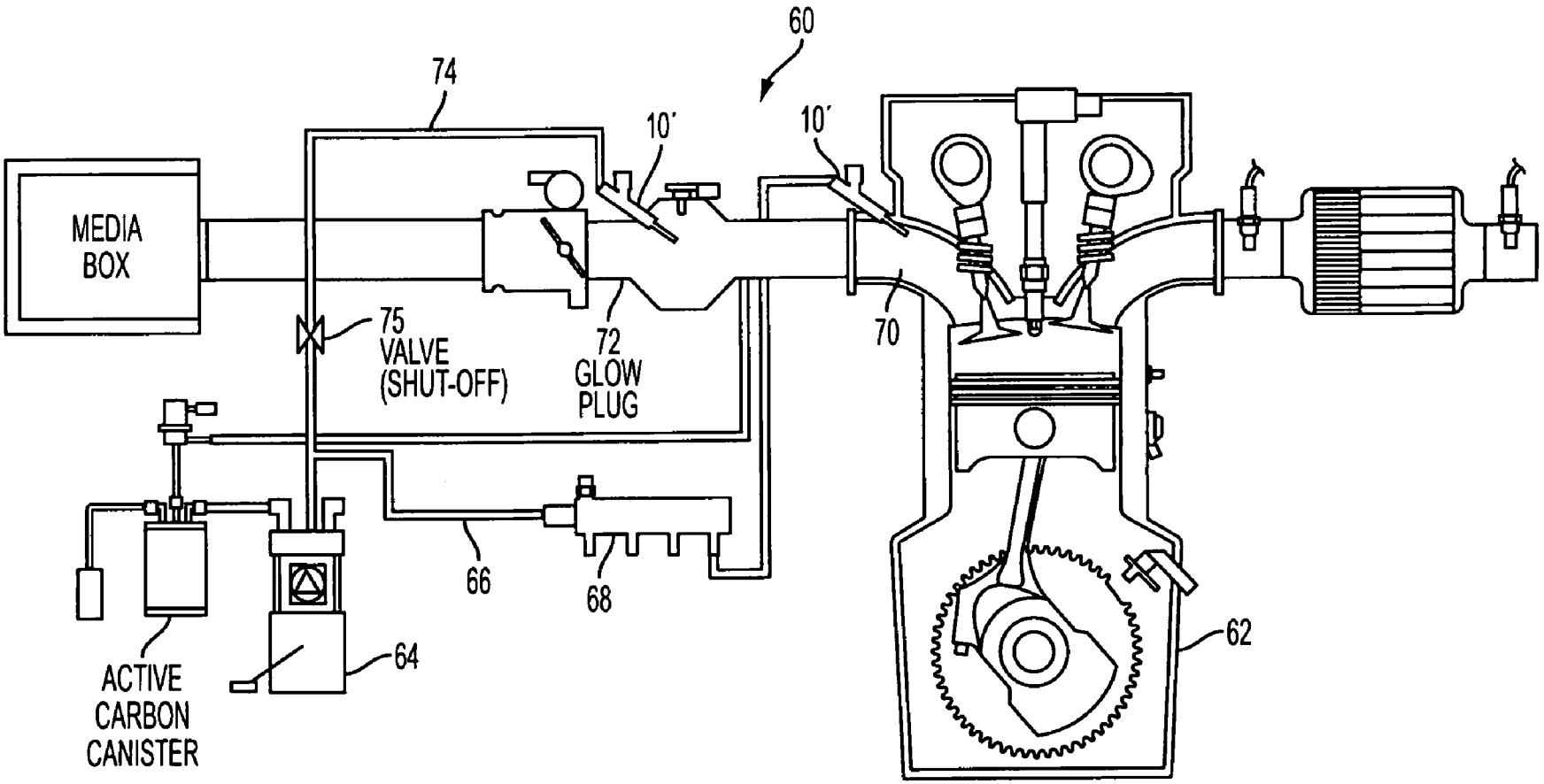
FIG. 3 is a view of a fuel injector system in accordance with the principles of an embodiment of the invention.

Referring to FIG. 1, a solenoid actuated fuel injector, generally indicated at 10, which can be of the so-called top feed type, supplies fuel to an internal combustion engine 62 (FIG. 3). The fuel injector 10 includes a valve body 14 extending along a longitudinal axis A. The valve body 14 includes a valve seat 18 defining a seating surface 22, which can have a frustoconical or concave shape, facing the interior of the valve body 14. The seating surface 22 includes a fuel outlet opening 24 centered on the axis A and in communication with an inlet tube 26 for conducting pressurized fuel into the valve body 14 against the seating surface 22. The inlet tube 26 defines an inlet end 15 of the injector 10 and has a retainer 30 for mounting the fuel injector 10 in a fuel rail (not shown) as is known. An O-ring 32 is used to seal the inlet end 15 in the fuel rail.

A closure member, e.g., a spherical valve ball 34, within the injector 10 is moveable between a first, seated, i.e., closed, position and a second, open position. In the closed position, the ball 34 is urged against the seating surface 22 to close the outlet opening 24 against fuel flow. In the open position, the ball 34 is spaced from the seating surface 22 to allow fuel flow through the outlet opening 24.

An armature 38 that is axially moveable along axis A in a tube portion 39 of the valve body 14 includes valve ball capturing means 40 at an end proximate the seating surface 22. The valve ball capturing means 40 engages with the valve ball 34 outer surface adjacent the seating surface 22 and so that the valve ball 34 rests on the seating surface 22 in the closed position of the valve ball 34. A spring 36 biases the armature 38 and thus the valve ball 34 toward the closed position. The fuel injector 10 may be calibrated by positioning adjustment tube 37 axially within inlet tube 26 to preload spring 36 to a desired bias force. A filter 39 is provided within the tube 37 to filter fuel. The valve body 14, armature 38, valve seat 18 and valve ball 34 define a valve group assembly such as disclosed in U.S. Pat. No. 6,685,112 B1, the contents of which is hereby incorporated herein by reference.

The electromagnetic coil 44 surrounds a pole piece or stator 47 formed of a ferromagnetic material. The electromagnetic coil 44 is operable, in the conventional manner, to produce magnetic flux to draw the armature 38 away from the seating surface 22, thereby moving the valve ball 34 to the open position and allowing fuel to pass through the fuel outlet opening 24. Deactivation of the electromagnetic coil 44 allows the spring 36 to return the valve ball 34 to the closed position against the seating surface 22 and to align itself in the closed position, thereby closing the outlet opening 24 against the passage of fuel. The electromagnetic coil is DC operated. The coil 44 with bobbin, and stator 47 are preferably overmolded to define a power or coil subassembly such has disclosed in U.S. Pat. No. 6,685,112 B1.

A non-magnetic sleeve 46 is pressed onto one end of the inlet tube 26 and the sleeve 46 and inlet tube 26 are welded together to provide a first hermetic joint therebetween. The sleeve 46 and inlet tube 26 are then pressed into the valve body 14, and the sleeve 46 and valve body 14 are welded together to provide a second hermetic joint therebetween.

The fuel passage 41 is defined inside the valve body 14 such that fuel introduced into the inlet end 15 passes over the valve ball 34 and through the outlet opening 24 when the valve ball 24 is in the open position.

Figure 2:
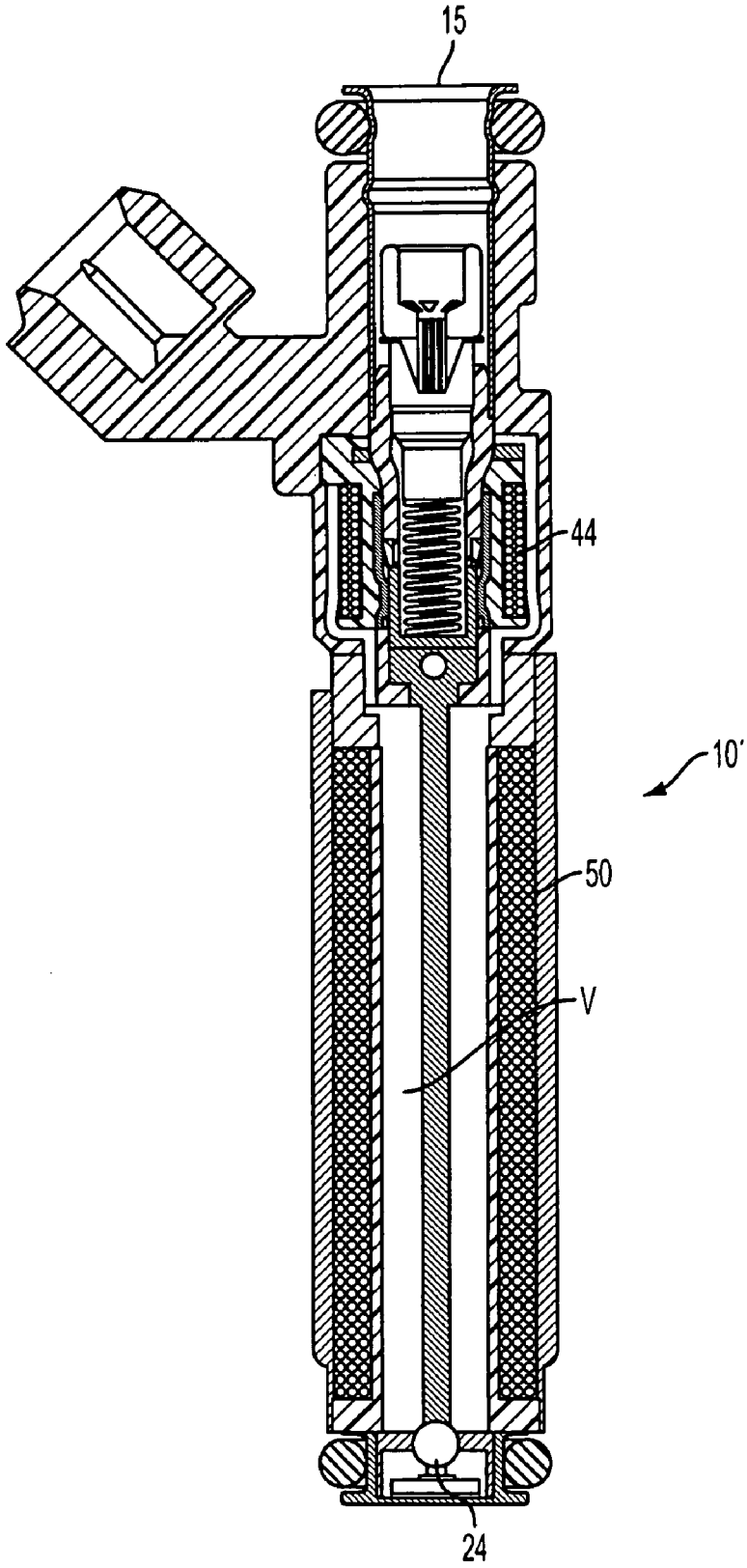
FIG. 2 is another embodiment of an injector having an increase fuel heating volume.

As shown in FIG. 1, a coil 50 is disposed about the tube portion 39 of the valve body 14 and is energizable to provide an electromagnetic field that heats the valve body, thereby vaporize liquid fuel in a volume of fuel injector (see volume V, FIG. 2). Thus, the coil 50 atomizes fuel using inductive heating in the injector 10 where the liquid fuel is vaporized prior to exiting the outlet opening 24 for use during the cold start phase. Vaporized fuel will readily mix with the inlet air to enable a much reduced HC emission cold start. This is accomplished through the ability to more efficiently control the ignition and combustion properties during the cold start to promote rapid catalyst warm-up while maintaining operator drivability. A benefit is the ability to enable an open inlet valve injection strategy with reduced transient fueling issues.

The coil 50 operates on alternating current (AC) via a circuit described in co-pending application Ser. No. 11/723,050, the contents of which is hereby incorporated by reference into this specification. Only two wires are required to connect the injector 10 to an Engine Control Unit (not shown). Thus, a two wire electrical connector 48 is used to power the injector 10.

The electromagnetic coil 44 uses the conventional pulse width DC modulation to open and close the injector 10. The coil 50, on the same circuit, uses AC current to inductively heat a portion of the armature 38. Preferably, the coil 50 is a two layer winding with 22 gage square wire and 50 turns. The AC to the heating coil 50 can be turned on or off based on when vapor is needed. The injector 10 can be used in alcohol and gasoline, and flex fuel applications.

As shown in FIG. 1, the coil 50 and the electromagnetic coil 44 are preferably provided as a unit for ease in assembly. The coil 50 surrounds the valve body 14. Preferably, there is an air gap between the coil 50 and the valve body 14 to keep a bobbin of the coil 50 from melting. A wall of the valve body is made thin enough so as to be heated by the coil 50. The fuel passage 41 is provided between an inside of the tube portion 39 of the valve body 14 and the outer periphery of the armature 38 so as to quickly heat the fuel. The armature 38 is of hollow tube shape and is constructed and arranged to direct the fuel around the outside of the tube. Since the armature 38 is a hollow tube, it is light-weight and has a reduced heat mass so it can also heat quickly.

With reference to FIG. 2, another embodiment of a heating injector 10' is shown. The injector 10' is substantially similar to the injector 10 of FIG. 1, except that injector 10' has an increased fuel heating volume V. Thus, the heating volume is increased from 0.1 cc (FIG. 1) to 0.9 cc (FIG. 2).

The injector 10' can be used for Flex Fuel Start applications to reduce emissions when E100 and E85 are the fuels used. The injector 10' enables efficient vehicle starts with E100 down to temperatures of −5 C with 200 W heating power even if flash boiling is interrupted. In conventional E100 applications, a vehicle will not start at 20 C and these applications require an additional gasoline tank as a start system.

Referring to FIG. 3 of the drawings, a fuel injection system, generally indicated at 60, is provided for a combustion engine 62. The system 60 is shown using fuel injectors 10'. However, fuel injectors 10 can be used in place of injectors 10'. A fuel pump 64, provided in a fuel tank (not shown) of a vehicle, delivers fuel to a fuel rail 68 via line 66. The fuel rail 68 supplies fuel to fuel injectors 10'. A fuel injector 10' is associated with a cylinder 70 of the engine 62. Thus, if the engine 62 is a four cylinder engine, four fuel injectors 10' are supplied with fuel from the fuel rail 68. The injectors 10' generate an amount of fuel vapor prior to injection and thus supply vaporized fuel to the engine 62 upon injection. It is preferable to use a fuel injector with increased volume V, such as injector 10', at each cylinder 70 so that a sufficient volume of fuel can be heated prior to injection by the injectors 10'. By increasing the volume of heated fuel, a smaller heater driver can be used and a more cost effective system solution can be obtained.

In accordance with another aspect of the embodiment shown in FIG. 3, an additional heating injector 10 or 10' may be provided upstream of the cylinders 70 in the air supply passage 72 that supplies air to the cylinders 70. The additional or cold start injector 10 or 10' is supplied with fuel via supply line 74 that is connected with the fuel pump 64. A valve 74 is provided in supply line to control supplying of fuel to the cold start injector 10 or 10'.

In the fuel supply system 60 of the embodiment, N+1 fuel injectors 10 or 10' are provided, with N being the number of cylinders 70 of the engine 62. The additional, or cold start injector 10 or 10' in the supply passage 72, is used as a cold start injector as well as a supplemental fuel delivery injector when alcohol or flex fuels are used in combustion.

Some features of the injectors 10 and 10' of the system 60 are as follows. The injector 10 or 10' with coil 50 enables lower cold start HC emissions. Lean operation with stable combustion is achieved during the cold warm-up phase. The injector 10 or 10' may be operated with retarded spark timing as a heat source for faster catalyst light-off. The injector 10 or 10' offers a system with minor modifications to customers' engines. With the injector 10 or 10', an increase of system LR can be achieved due to operation on vapor at low demand conditions.

With the injector 10, 10' in E85 applications, the oil dilution is reduced by about 2.5 times and the start emissions are significantly reduced and are equal to that of a gasoline application. The injector 10' enables efficient vehicle starts with E85 down to temperatures of −30 C.

Thus, with the injectors 10 or 10' in the system 60, sufficient thermal energy is added to the fuel that injected directly into the cylinders, improving cold start performance and reducing engine cold emissions. The use of the additional cold start injector in the air supply passage further increases performance.

The foregoing preferred embodiments have been shown and described for the purposes of illustrating the structural and functional principles of the present invention, as well as illustrating the methods of employing the preferred embodiments and are subject to change without departing from such principles. Therefore, this invention includes all modifications encompassed within the spirit of the following claims.

What is claimed is:

1. A fuel injection system for an internal combustion engine, the engine having a plurality of cylinders, the system comprising:

a fuel pump, and a plurality of fuel injectors constructed and arranged to receive fuel from the fuel pump, one fuel injector being associated with a cylinder for injecting fuel into the associated cylinder, each fuel injector having a valve body, a fuel volume, a first coil for opening the fuel injector to permit fuel flow there-from and a separate, second coil constructed and arranged to inductively heat the valve body and thus heat fuel in the fuel volume to vaporize the fuel prior to injection into the associated cylinder.

2. The system of claim 1, further comprising a cold start fuel injector disposed in an air supply passage upstream of the cylinders that supplies air to the cylinders, the cold start fuel injector has a valve body, a fuel volume, a first coil for opening the fuel injector to permit fuel flow there-from, and a separate, second coil constructed and arranged to inductively heat the valve body and thus heat fuel in the fuel volume to vaporize the fuel prior to injection into the supply passage.

3. The system of claim 2, wherein the fuel pump directly supplies fuel to the cold start fuel injector via a supply line.

4. The system of claim 3, further comprising a valve in the supply line for controlling the supply of fuel to the cold start fuel injector.

5. The system of claim 1, wherein the second coil is constructed and arranged to generate an electromagnetic field to heat the valve body.

6. The system of claim 1, wherein the fuel is one of alcohol, gasoline or flex fuel.

7. The system of claim 1, wherein the fuel volume is about 0.9 cc.

8. The system of claim 1, wherein each fuel injector includes only a two wire connector for powering both the first coil and the second coil.

9. The system of claim 1, further including a fuel rail, each fuel injector being fluidly connected with the fuel rail, the fuel pump being constructed and arranged to deliver fuel to the fuel rail with the fuel rail supplying fuel to the fuel injectors.

10. The system of claim 1, wherein the first coil is direct current (DC) operated and the second coil is alternating current (AC) operated.

11. A fuel injection system for an internal combustion engine, the engine having a plurality of cylinders, the system comprising:

a plurality of fuel injectors constructed and arranged to receive fuel, one fuel injector being associated with a cylinder for injecting fuel into the associated cylinder, each fuel injector having a valve body, a fuel volume, and a coil constructed and arranged to inductively heat the valve body and thus heat fuel in the fuel volume to vaporize the fuel prior to injection into the associated cylinder, and a cold start fuel injector disposed in an air supply passage upstream of the cylinders that supplies air to the cylinders, the cold start fuel injector having a valve body, a fuel volume, and a coil constructed and arranged to inductively heat the valve body and thus heat fuel in the fuel volume to vaporize the fuel prior to injection into the supply passage.

12. The system of claim 11, wherein the fuel volume is about 0.9 cc.

13. The system of claim 11, wherein the fuel is one of alcohol, gasoline or flex fuel.

14. The system of claim 11, wherein each coil is constructed and arranged to generate an electromagnetic field to heat the valve body.

15. The system of claim 14, wherein body wherein each fuel injector and the cold start fuel injector includes a solenoid, each fuel injector and the cold start fuel injector includes only a two wire connector for powering both the solenoid and the heating coil.

16. The system of claim 11, further comprising a fuel pump and a fuel rail, each fuel injector being fluidly connected with the fuel rail, the fuel pump being constructed and arranged to deliver fuel to the fuel rail with the fuel rail supplying fuel to the fuel injectors.

17. The system of claim 16, wherein the fuel pump directly supplies fuel to the cold start fuel injector via a supply line.

18. The system of claim 17, further comprising a valve in the supply line for controlling the supply of fuel to the cold start fuel injector.

19. A method of adding energy to fuel in a fuel injection system for a vehicle having a plurality of cylinders, the method comprising:

providing a fuel injector associated with a cylinder for injecting fuel into the associated cylinder, each fuel injector having a valve body, a fuel volume, a first coil for opening the fuel injector to permit fuel flow there-from, and a separate, second and a coil, supplying each fuel injector with fuel, activating the second coil to generate a magnetic field to inductively heat the valve body to vaporize the fuel in the fuel volume, and activating the first coil to inject the vaporized fuel into the associated cylinder.

20. The method of claim 19, further comprising:

providing a cold start fuel injector disposed in an air supply passage upstream of the cylinders that supplies air to the cylinders, the cold start fuel injector having a valve body, a fuel volume, a first coil for opening the fuel injector to permit fuel flow there-from, and a separate, second coil, and supplying the cold start fuel injector with fuel, activating the second coil of the cold start fuel injector to generate a magnetic field to inductively heat the valve body to vaporize the fuel in the fuel volume, and activating the first coil to inject the vaporized fuel into the air supply passage.

* * * * *